US005855348A

United States Patent [19]

Fornara

[11] Patent Number: 5,855,348

[45] Date of Patent: Jan. 5, 1999

[54] SHOWER HEAD SUPPORT WITH ADJUSTABLE ARM

[75] Inventor: Marco Fornara, Omegna, Italy

[73] Assignee: Fornara & Maulin Spa, Gravellona Toce, Italy

[21] Appl. No.: 788,956

[22] Filed: Jan. 24, 1997

[30] Foreign Application Priority Data

Jan. 25, 1996 [IT] Italy ..... MI96A0127

[51] Int. Cl.[6] ..... E04G 3/00

[52] U.S. Cl. ..... 248/291.1; 248/286.1

[58] Field of Search ..... 248/286.1, 291.1, 248/295.11, 298.1, 316.17, 514; 4/615, 567, 570; 239/460

[56] References Cited

U.S. PATENT DOCUMENTS

| | | | |
|---|---|---|---|
| D. 266,212 | 9/1982 | Hang | D6/86 |
| 309,349 | 12/1884 | Hart | 248/286.1 |
| D. 370,250 | 5/1996 | Fancett et al. | D23/213 |
| D. 378,401 | 3/1997 | Neufeld et al. | D23/304 |
| 694,888 | 3/1902 | Pfluger | 248/514 |
| 835,678 | 11/1906 | Hammond | 248/286.1 X |
| 1,046,573 | 12/1912 | Ellis | 248/286.1 |
| 1,327,428 | 1/1920 | Gregory . | |
| 2,011,446 | 8/1935 | Judell . | |
| 2,216,149 | 10/1940 | Weiss | 4/615 X |
| 2,727,707 | 12/1955 | Wells | 248/514 |
| 2,733,035 | 1/1956 | Rocheleau | 248/286.1 X |
| 3,012,731 | 12/1961 | Williams | 248/286.1 X |
| 4,458,369 | 7/1984 | Santi | 4/615 X |
| 4,741,504 | 5/1988 | Monroe | 248/286.1 |
| 5,277,391 | 1/1994 | Haug et al. | 248/295.11 X |
| 5,396,915 | 3/1995 | Bomar | 248/514 X |
| 5,481,765 | 1/1996 | Wang | 4/615 X |
| 5,632,049 | 5/1997 | Chen | 4/570 |

FOREIGN PATENT DOCUMENTS

| | | |
|---|---|---|
| 252317 | 10/1948 | Switzerland . |
| 340460 | 9/1959 | Switzerland . |
| 666077 | 2/1952 | United Kingdom . |

*Primary Examiner*—Leslie A. Braun
*Assistant Examiner*—Anita M. King
*Attorney, Agent, or Firm*—Sughrue, Mion, Zinn, Macpeak & Seas, PLLC

[57] ABSTRACT

A shower head support comprises a supporting tube (14) on which a sliding element (46) with an adjustable seat for a shower head (52) can slide and be locked in position. The tube or arm on which the sliding element slides is supported at only one end on a fixed base (12) so that it can be rotated to assume and maintain a desired position around an axis of rotation (a). The new support allows the shower head to be set at a desired height using an arm half the length of the vertical arms commonly used at the present that are fixed at both ends; it also allows the shower head to be set easily in a variety of desired positions around the axis of rotation.

14 Claims, 3 Drawing Sheets

SHOWER HEAD SUPPORT WITH ADJUSTABLE ARM

DESCRIPTION

The invention refers to the field of shower installations.

The shower installations currently in use can be divided into two main categories: stationary head installations and movable head installations. Stationary head installations comprise a head generally applied to a vertical wall or top or ceiling of the shower cubicle; although these heads offer some scope for rotational adjustment, this is generally limited, representing a drawback of this type of installation.

Shower installations with a mobile head generally comprise a head equipped with a grip that can be hand-held and connected to the hot and cold water supply by means of a so-called hose. These installations have the drawback that the user always has one hand occupied holding the shower head.

For some time now wide use has been made of installations that combine the advantages of the mobile shower head with those of the stationary shower head in that they combine a mobile shower head with a fixed support for the head consisting of a vertical rail fixed at the ends to a wall and equipped along its length with a sliding element to support the shower head. The sliding element can be moved along the supporting rail and fixed in a desired position on it by means of a spring and jaw system, on which the user can act through a push-button or other means, so as to neutralise the action of the spring on the jaw when he decides to change the position of the sliding element. The sliding element preferably has a groove as a seat for the shower head, the part with the groove being adjustable on the body of the sliding element to tilt the shower head as desired.

Although these installations have met with the users' favour, they nevertheless still have some drawbacks; in particular, the shower head position can be adjusted only vertically, that is to say in every position the shower head always stays adjacent to or very close to the wall along which the support is fixed. A further drawback is due to the fact that for installation holes have to be made in the wall at two points set apart from each other.

The aim was to overcome the drawbacks mentioned above. These aims have been achieved by means of a device as stated in claim 1. Further new and inventive characteristics are stated in the subsequent claims.

In other words, the new shower support comprises a generally tubular arm restrained to a base to be fixed to the wall; the base is joined to one end of said arm and comprises means that allow rotation and angular positioning of said arm around an axis defined in the base, said arm being able to rotate around said axis when it is subjected to a pre-set or greater force and being able to remain stable in any angular position around said axis. On the arm thus supported at only one end a sliding element can slide to support the shower head, which can be of any per se known type. The axis of rotation of the arm is preferably at right angles to the longitudinal extent of the arm; this axis is advantageously parallel to a plate for fixing the base to the wall, although a possible embodiment with the axis at right angles to the base fixing plate is provided.

An alternative embodiment provides the possibility of rotation of the arm around two axes at right angles or slantwise to each other: for example one section of the base can be made rotatable with respect to the other.

The possibility of adjusting the arm on the base is achieved by making the arm with a pivot integral with it and retained in a plate integral with the base by means of a screw screwed into the pivot with a suitably calibrated force, washers being provided between a shoulder of the pivot and a shoulder of the base plate and between the head of the screw and an opposite shoulder of the base plate.

A supporting and guiding element for the shower head hose, suitably provided with a peripheral seat for said hose is advantageously provided around a part of the tube forming the arm and/or a part of the pivot.

The new shower support allows the shower head to be positioned with respect to a fixed base over a whole surface area defined by a circle with a radius equal to the extension of the arm around is own axis of rotation. In particular the new support allows a vertical extension equal to that previously covered by fixed rail supports to be covered by means of an arm stretching only half the length of the vertical fixed rail of previous installations. Moreover, the new support can be installed making the necessary fixing holes for the base in only one position on the wall.

A currently preferred embodiment of the shower head support will be described below purely by way of non-limiting example with reference to the attached drawings in which.

Figure 4:
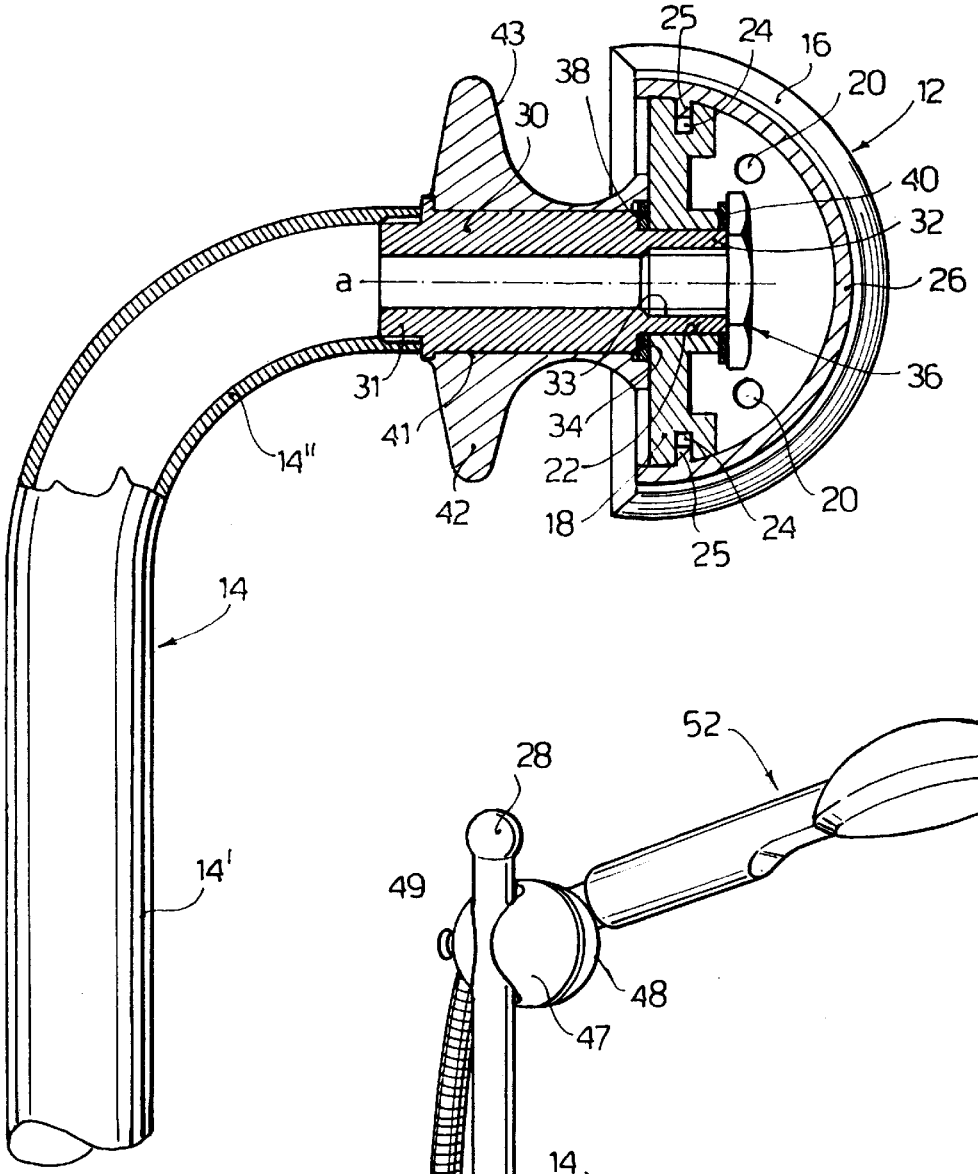
FIG. 4 is a section along a plane indicated by 4—4 in FIG. 1.
Figure 3:
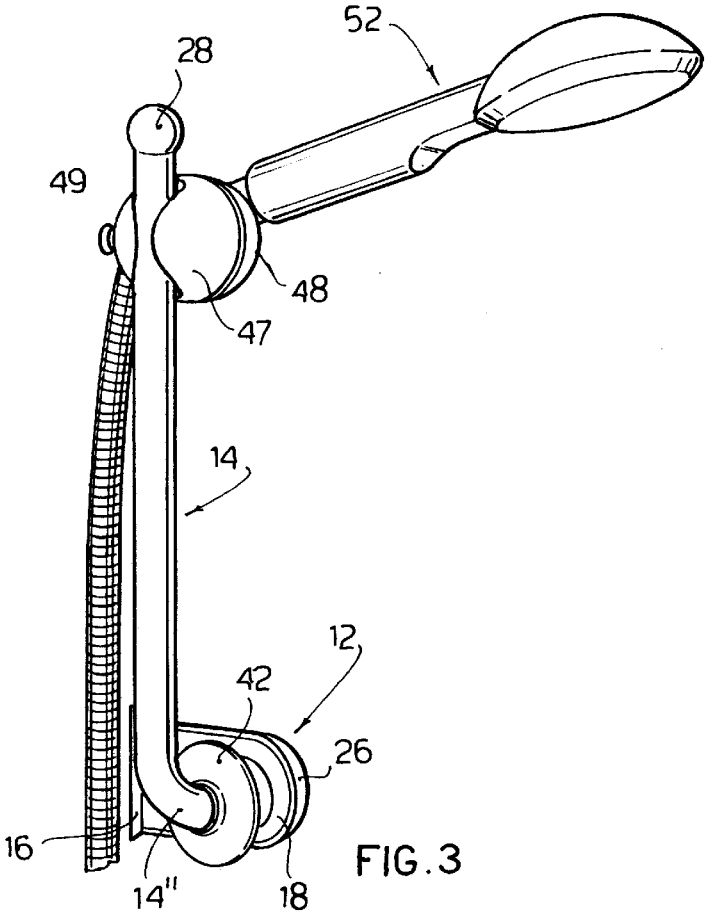
FIG. 3 is a perspective view, on a further reduced scale, of the shower head support in a vertical position extending upwards, with a sliding element in the extreme top position and a shower head applied to the sliding element.

A new shower support, referenced as a whole by 10 in the drawings, comprises a fixing base 12 and an adjustable or positioning arm 14. The fixing base 12 comprises a first plate 16 and a second plate 18, substantially at right angles to the first. The plate 16 (FIG. 4) has two fixing holes 20 so that it can be fixed to a wall, for example to a vertical wall P shown in FIG. 1, by means of fixing devices not shown, for example screw anchors. The plate 18 has a circular seat 22 passing through it around an axis a at right angles to the plane of said plate 18 and substantially parallel to the plane of the plate 16. The plate 18 advantageously has two parallel opposite channels, 24 and 24, to receive the engaging ribs, 25 and 25, of a cover indicated by 26, having a semi-cylindrical shape.

The arm 14 substantially comprises a length of tube that has a straight portion 14' ending distally in a knob or spherical body 28 with a slightly greater diameter than the diameter of the tube 14. At the opposite end the arm 14 is curved into 14" and is fitted in a non-rotating forced manner on an end 31 of a pivot 30. On the opposite side to the end 31 forced onto the tube 14, the pivot 30 has a neck 32 threaded on the inside at 33. The neck 32 is defined by a shoulder of the pivot, indicated by 34. The neck 32 has an external diameter such as to be accommodated inside the seat 22 of the plate 18. The pivot 30 is accommodated in the seat 22 coaxially to the axis a thereof, defined earlier, and is locked axially in this position by means of a wide-headed screw 36 the stem of which engages with the thread 33. A first nylon washer 38 is set between the shoulder 34 of the pivot and the plate. A second nylon washer 40 is set between the head of screw 36 and the plate. Tightening of the screw 36 on the thread 33 is calibrated so that the pivot can be rotated with respect to the seat 22 only with a certain force, so that when such a force is applied to the arm 14 as to give a lower moment than that set, it is not possible to turn the arm 14.

On the body of the pivot 30 a cylindrical surface 41 is preferably defined around which a guide reel 42 is accommodated having a circular seat 43 to accommodate and guide the shower head hose, if deemed convenient. The reel 42 can be integral with the pivot 30 in its rotation or it can turn freely on the pivot.

Figure 1:
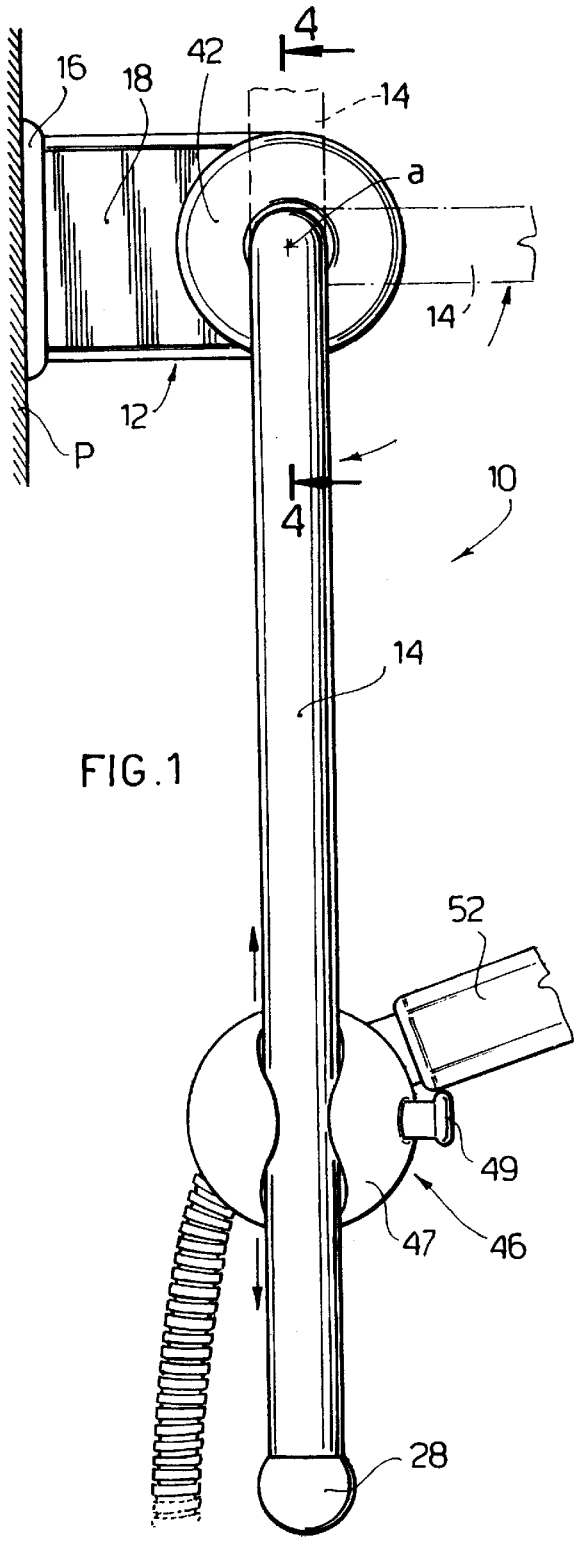
FIG. 1 is a side view on a reduced scale of an embodiment of the new wall-mounted shower head support, in a lowered state, with a sliding element applied to it and a shower-head (broken off) on the sliding element; further positions that can be assumed by the arm of the support are indicated (broken off) by a chain-dotted line and by a dash line.
Figure 2:
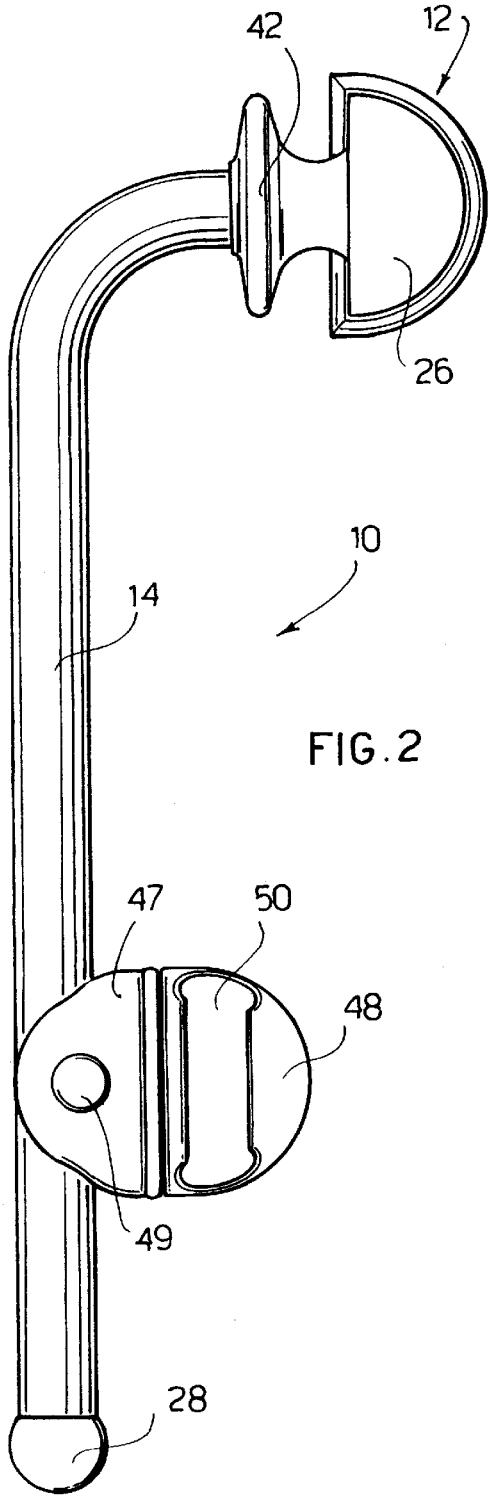
FIG. 2 is a view from the right with respect to FIG. 1 but the shower head is not shown in it.

It will be understood that in this way the arm 14 is adjustable in position around the axis a in a wide range of positions which, in the example illustrated in the figures, vary by about 180° from the position drawn with the unbroken line in FIG. 1 and the position in line with it indicated with a dash line in FIG. 1. With a different configuration and application of the base 16, for example with a base 16 in which the fixing plate part 16 is at right angles to the axis a, the possibility of 360° positioning of the arm 14 around the axis a could be achieved. The chosen position around the axis a is maintained unless forces that determine moments greater than that set are applied to the arm 14. Before application of the knob 28, a sliding element 46 which can be of the traditional type and therefore is not described here in detail, is applied to the arm 14. The sliding element 46 comprises a half-element 47 and a half-element 48, the half-element 48 being angularly adjustable on the half-element 47. The half-element 47 has a seat to receive arm 14, equipped in a per se known manner with a spring-loaded locking jaw, a push-button 49 being provided to act against a spring to open the jaw when it is wished to slide the sliding element along the rail. The half-element 48 has a seat 50 for a shower head which is therefore adjustable in position with respect to half-element 47. It will therefore be seen that the shower head indicated by 52 in the drawings can take any position along the rail 14 and, since this can take an angular position around the axis a, the shower head can occupy any position on a surface defined by a semicircle with its centre on the axis a and a radius equal to the length of the arm 14 in the example illustrated in the figures or, in the other example proposed (axis a perpendicular to the fixing base 16), along a surface defined by a whole circumference with a radius equal to the length of the arm.

It will be clear from the foregoing that to obtain the possibility of vertical movement of a length l, for example, it will no longer be necessary to provide an arm with a length l as in the preceding systems, but simply an arm 14 with a length l/2. Not only that, but this arm with a length l/2 will also allow positioning at a distance 1/2 (plus the plate 18) from the fixing wall, something which was not permitted by previous installations.

Figure 5:
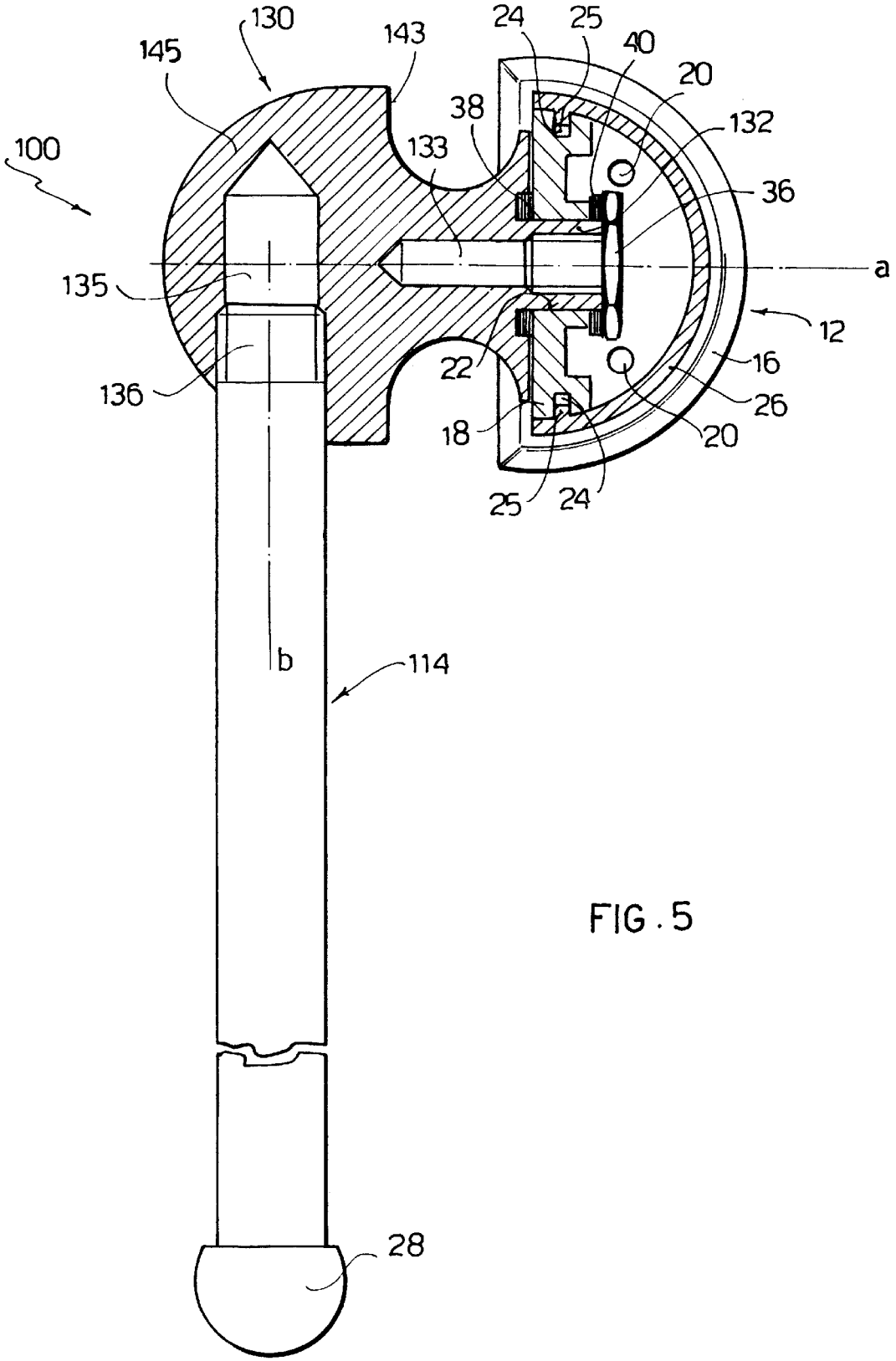
FIG. 5 is a part sectional side view of a modified embodiment of the shower head support.

A variant of the shower head support is illustrated in FIG. 5, in which the parts of the support that remain unchanged have the same reference numbers as in the preceding figures.

The shower support in FIG. 5, indicated as a whole by 100, comprises a fixing base 12 and an adjustable or positioning arm 114. The fixing base 12 comprises a first plate 16 and a second plate 18 substantially at right angles to the first. The plate 16 has two fixing holes 20 so that it can be fixed to a wall, for example a vertical wall P marked in FIG. 1, by means of fixing devices not shown, for example anchors. The plate 18 has a circular through seat 22 around an axis a at right angles to the plane of said plate 18 and substantially parallel to the plane of plate 16. The plate 18 has two parallel facing grooves, 24 and 24, to receive engaging ribs, 25 and 25, of a cover indicated by 26, having a semi-cylindrical shape.

A spool 130 is engaged with its neck 132 in the above mentioned seat 22; a hole 133 in the spool is threaded on the inside for engagement of the threaded stem of a screw 36. Between the head of the screw 36 and the plate 18 and between a shoulder on the spool 130 and the plate 18 are interposed respective nylon washers 38, 40. Engagement between the spool 130 and the seat 22 is similar to that between the pivot 30 and the seat 22 described for the previous embodiment, that is to say it is such as to permit rotation under force but to remain locked under the normal loads due to the weight of the working shower head and the arm.

The spool 130 preferably has a seat or cavity 143 on the outside extending around the circumference, of a suitable size to receive a shower hose. The body 145 of the spool has a threaded cavity 135, generally with an axis b at right angles to a. A threaded end of the rail or arm 114 engages in the thread 136 of the cavity 135. However, engagement between the arm and the spool could be of a type other than screwing.

The end of the arm 114 opposite the spool bears a knob 28 similar to that of the previous embodiment.

In another embodiment of the shower support, not illustrated, provision is made for the base to be made in two parts, a fixed part having the plate 16 for attachment to the wall, and another moving part bearing the axis a. The moving part is assembled on the fixed part so as to be able to take on a variety of angular positions with respect to it around a second axis at right angles to the axis a or slantwise to it. The second base section can be assembled so as to rotate on the first in any known way.

I claim:

1. A shower head support comprising:

a fixing base having a fixing base plate for fixing said base to a shower or bathroom wall;

a substantially L-shaped arm, said arm being defined by opposite distal ends and operatively supporting a sliding element for a shower head at least when said shower head is passing water, and whereby said sliding element can be positioned on a first leg of said L-shaped arm and adapted to slide longitudinally therealong, wherein said arm second leg is adapted to be rotatably adjustable about a first axis extending along said second leg of said arm with one of said opposite ends of said arm engaging said base, the first leg of said arm including said other of said opposite ends of the arm being free.

2. A shower head support according to claim 1, characterized in that said first axis (a) is substantially perpendicular to the longitudinal extension of the arm and to said fixing plate of said base.

3. A shower head support according to claim 1, characterized in that said base has a first fixing plate portion 16 for attachment to and parallel with the wall and a second fixing plate portion 18 attached to and orthogonal to said first fixing plate portion, the arm at said one end engaging said base being integral with a pivot (30); said base (12) has a circular seat (22) for said pivot; and movement resisting means being provided to restrain said pivot and said seat so that reciprocal rotation is allowed only if greater moments than a pre-set moment are applied to the arm.

4. A support according to claim 3, characterized in that said pivot has a shoulder part and neck-shaped internally threaded end part (32) engaging with a screw with a wide head (36), a first washer (38) being provided between said shoulder of said pivot and said second fixing plate portion and a second washer (40) between the wide head of the screw and said second fixing plate portion, said screw being screwed into the pivot with a preset calibration.

5. A shower head support according to claim 1, characterized in that the free end of the arm is provided with a knob (28) with a slightly greater diameter than that of the arm to prevent the sliding element from slipping off of said free end.

6. A shower head support according to claim 1, characterized in that said arm is rotatably adjustable around said first axis, said first axis being parallel to said fixing base plate.

7. A shower head support according to a claim 1, characterized in that said arm is rotatably adjustable around an axis of rotation which is perpendicular to said fixing base plate.

8. A shower head support according to claim 1, characterized in that said base is made of two sections, a first section for fixing to the wall and a second section, bearing said arm, rotatably adjustable on the first section about a second axis different from said first axis.

9. A shower head support according to claim 8, characterized in that said second section of the base is rotatably adjustable on the first section around said second axis at a right angle to the first axis of rotation of the arm on the second section.

10. A shower head support according to claim 1, characterized in that said support comprises a spool (130) between said base (12) and said arm (114), said spool being coupled to the base to be rotatably adjustable on it, said arm (114) being fixed to the spool.

11. A shower head support according to claim 10, characterized in that the spool has a circular seat (143) to receive a length of shower hose.

12. A shower head support according to claim 10, characterized in that said base and spool comprise a circular seat (22) in the base, a neck (132) of the spool being accommodated in said seat and engaged by a screw (36).

13. A support according to claim 1 wherein said arm is rotatable through approximately 180° between two opposed positions proximate the wall in each position.

14. A shower head assembly comprising:

a shower head;

a support comprising:

a fixing base having a fixing base plate for fixing said base to a shower or bathroom wall;

a substantially L-shaped arm, said arm being defined by opposite distal ends and operatively supporting a sliding element for said shower head at least when said shower head is passing water, and whereby said sliding element can be positioned on a first leg of said L-shaped arm and adapted to slide longitudinally therealong, wherein said arm second leg is adapted to be rotatably adjustable about a first axis extending along said second leg of said arm with one of said opposite ends of said arm engaging said base, the first leg of said arm including said other of said opposite ends of the arm being free.

* * * * *

UNITED STATES PATENT AND TRADEMARK OFFICE

CERTIFICATE OF CORRECTION

PATENT NO. : 5,855,348

DATED : January 5, 1999

INVENTOR(S) : FORNARA, MARCO

It is certified that error appears in the above-identified patent and that said Letters Patent is hereby corrected as shown below:

Title page, item [73]:

Please change the Name of the Assignee from "FORNARA & MAULIN SPA" to --FORNARA & MAULINI SPA--.

Signed and Sealed this

Thirty-first Day of August, 1999

*Attest:*

Q. TODD DICKINSON

*Attesting Officer*

*Acting Commissioner of Patents and Trademarks*